US008998584B2

(12) United States Patent
Steen et al.

(10) Patent No.: US 8,998,584 B2
(45) Date of Patent: Apr. 7, 2015

(54) ELECTRO-OSMOTIC APPARATUS, METHOD, AND APPLICATIONS

(75) Inventors: Paul H. Steen, Ithaca, NY (US); Michael J. Vogel, Voorhees, NJ (US)

(73) Assignee: Cornell University, Ithaca, NY (US)

( * ) Notice: Subject to any disclaimer, the term of this patent is extended or adjusted under 35 U.S.C. 154(b) by 0 days.

(21) Appl. No.: 13/574,702

(22) PCT Filed: Jan. 24, 2011

(86) PCT No.: PCT/US2011/022203

§ 371 (c)(1),
(2), (4) Date: Jul. 23, 2012

(87) PCT Pub. No.: WO2011/091345

PCT Pub. Date: Jul. 28, 2011

(65) Prior Publication Data

US 2012/0301324 A1 Nov. 29, 2012

Related U.S. Application Data

(60) Provisional application No. 61/297,881, filed on Jan. 25, 2010.

(51) Int. Cl.

| | |
|---|---|
| ***F04F 99/00*** | (2009.01) |
| ***F04B 37/02*** | (2006.01) |
| *B01L 9/00* | (2006.01) |

(52) U.S. Cl.
CPC ... *F04B 37/02* (2013.01); *B01L 9/00* (2013.01)

(58) Field of Classification Search
CPC ..... F04B 19/006; F04B 19/24; H01J 7/18
USPC ..... 417/48
See application file for complete search history.

(56) References Cited

U.S. PATENT DOCUMENTS 3,267,859 A * 8/1966 Jutila ..... 417/48
5,180,288 A * 1/1993 Richter et al. ..... 417/48

(Continued)

OTHER PUBLICATIONS

Barz, Dominik P.J. et al.; Determination of the Zeta Potential of Porous Substrates by Droplet Deflection. I. The Influence of Ionic Strength and pH Value of an Aqueous Electrolyte in Contact with a Borosilicate Surface; Langmuir 2009, 25, 1842-1850; American Chemical Society.

(Continued)

*Primary Examiner* — Peter J Bertheaud
(74) *Attorney, Agent, or Firm* — William Greener; Bond, Schoeneck & King, PLLC

(57) ABSTRACT

A switchable adhesion device combines two concepts: the surface tension force from a large number of small liquid bridges can be significant (capillarity-based adhesion) and these contacts can be quickly made or broken with electronic control (switchable). The device grabs or releases a substrate in a fraction of a second via a low voltage pulse that drives electroosmotic flow. Energy consumption is minimal since both the grabbed and released states are stable equilibria that persist with no energy added to the system. The device maintains the integrity of an array of hundreds to thousands of distinct interfaces during active reconfiguration from droplets to bridges and back, despite the natural tendency of the liquid towards coalescence. Strengths approaching those of permanent bonding adhesives are possible as feature size is scaled down. The device features compact size, no solid moving parts, and is made of common materials.

20 Claims, 5 Drawing Sheets

(56) References Cited

U.S. PATENT DOCUMENTS

| | | | | |
|---|---|---|---|---|
| 7,431,570 | B2 * | 10/2008 | Young et al. | 417/208 |
| 8,319,126 | B2 * | 11/2012 | Steen et al. | 200/182 |
| 2002/0166592 | A1 | 11/2002 | Liu et al. | |
| 2008/0037931 | A1 | 2/2008 | Steen et al. | |
| 2008/0260542 | A1 | 10/2008 | Nishikawa et al. | |
| 2009/0136362 | A1 * | 5/2009 | Yanagisawa et al. | 417/48 |

OTHER PUBLICATIONS

Vogal et al.; The electroosmotic droplet switch: Countering capillarity with electrokinetics; PNAS, Aug. 23, 2005, vol. 102, No. 34, 11974-11979.

Park, Heon Young; International Search Report and Written Opinion; Korean Intellectual Property Office; Oct. 24, 2011.

* cited by examiner

ELECTRO-OSMOTIC APPARATUS, METHOD, AND APPLICATIONS

CROSS-REFERENCE TO RELATED APPLICATIONS

This application claims priority to U.S. provisional Patent Application Ser. Nos. 61/297,881 filed on Jan. 25, 2010, the subject matter of which is incorporated herein by reference in its entirety.

BACKGROUND OF THE INVENTION

1. Field of the Invention

Embodiments of the invention are generally in the field of fluid mechanics and, more particularly pertain to electro-osmotic, capillarity-based apparatus, methods, and applications thereof and, even more particularly to switchable, electro-osmotic, capillarity-based apparatus and methods, and applications in the areas of adhesion and force transduction.

2. Technical Background

United States Patent Application Publication No. US2008/0037931, the subject matter of which is incorporated herein by reference in its entirety, discloses the meanings of the terms 'switching device,' 'switching systems,' and 'capillary'. The '931 publication discloses, among other things, a retention system for the adhesive retention and release of one or more objects. The system includes a plurality of passageways arranged, adjacent to one another, each having two or more openings, and a force application system operatively associated with each individual passageway. A liquid in each of the passageways, having a volume that exceeds an internal volume of the plurality of passageways, forms a liquid drop around each of the openings. The force application system applies a force on the liquid to control switching between the two or more switch positions. The liquid drops are connected to one another by the liquid in each of the plurality of passageways. Each of the liquid drops is adjustable between two or more sizes and each of the sizes and a location of each of the liquid drops defines one of two or more switch positions. The liquid in each of the droplets has a wetability relative to the surface of the object that accommodates the object being retained or released by the droplets. Devices that operate with liquid droplets typically suffer from 'volume scavenging,' i.e., one droplet robbing volume from one or more adjacent droplets resulting in non-uniform droplet volumes and/or a coalescence of two or more droplets.

Certain animals exhibit extraordinary adhesion in daily activities and employ a variety of strategies to do so. The gecko is a prominent example, whose nano-fibrillar contacts are thought to rely on dry adhesion via van der Waals forces.

Wet adhesion strategies are also evident in nature, either relying on protein-based glues or a fluid mechanics-based bond via viscosity or surface tension.

Combined strategies have also been proposed for man-made devices (see, e.g., Lee H, Lee B P, Messersmith P B, A reversible wet/dry adhesive inspired by mussels and geckos, Nature 448:338-341 ((2007)).

The embodied invention as disclosed and claimed herein below, drew inspiration from the leaf beetle, an insect that achieves adhesion forces (~33 mN) exceeding 100 times its body-weight. This is accomplished through the parallel action of surface tension across many micron-sized droplet contacts as reported by Eisner T, Aneshansley D J (2000) Defense by foot adhesion in a beetle (Hemisphaerota cyanea), Proc Natl Acad Sci USA 97:6568-6573.

A liquid droplet caught between two glass slides pulls the slides together. The liquid surface tension $\sigma$ acts along the perimeter of the wetted contact-areas to give a force$\approx\sigma\pi\epsilon$ for a single contact, where $\epsilon$ is the contact diameter. In defending itself by adhesion, the beetle establishes a large number N of small contacts, each of wetted area $A_{wet}$. The beetle 'feet' project a total net area (i.e., including dry area between contacts) $A_{net}\approx 2\ mm^2$, and can deploy $N\approx 10^5$ contacts of $\epsilon\approx 2\ \mu m$. The net perimeter force scales as $N\sigma\pi\epsilon$, consistent with the measured adhesion of the beetle. To emphasize the geometric advantage of packing perimeter into a fixed area, we introduce a contact packing density $\phi\equiv NA_{wet}/A_{net}$. Using $\phi$ to eliminate N yields the perimeter force as $F\approx A_{net}(\phi/\epsilon^2)\sigma\epsilon$, showing that $F\propto 1/\epsilon$ for fixed $A_{net}$. This amplification of the perimeter force by $1/\epsilon$ illustrates the great benefit of packing a large number of small contacts into a fixed net area.

Similarly remarkable to the beetle's strength of adhesion is its quick ability to switch this bond on and off. Each contact can be thought of as switchable, and the beetle reconfigures its array of $10^5$ contacts in less than a second. The beetle thus demonstrates the functionality of large arrays of small-scale capillary contacts for switchable adhesion.

Conventional techniques to grab surfaces use a vacuum/suction strategy, which suffers an intrinsic limit of adhesion strength, one atmosphere (≈100 kPa), due to their principle of operation. Further disadvantages of a vacuum device are bulkiness and the high power required to initiate and sustain attachment. Alternate mechanisms for switchable adhesion that have been demonstrated, including control of surface chemistry by temperature or pH, result in transitions that can take from minutes to hours to realize.

In view of the aforementioned shortcomings and disadvantages with the state of the art, the inventors have recognized the benefits and advantages of droplet-based apparatus and methods for rapid and repeatable attachment/detachment to wood, brick, linoleum, plastics, metals, and other surfaces of various roughness, which are designed to minimize or eliminate volume scavenging effects. Potential applications of such technology include, for example, load-bearing "Post-it®"-like notes, wall-climbing with "spiderman"-type gloves, and others. Further benefits and advantages are contemplated by apparatus and methods that would provide control with a precision that enables grab-release waves to be propagated along an active joint between two surfaces, e.g., one flexible and the other rigid. Zipping and un-zipping of adhesive bonds against a flexible component opens the possibility of reconfiguring (morphing) objects to take different geometric shapes—all in real-time. Still further benefits and advantages could be realized by force transduction apparatus and methods capable of exerting a force on an adjacent surface, making possible applications such as a credit-card-form device that could, e.g., pry open a rock fissure.

SUMMARY

An embodiment of the invention is a switchable, electro-osmotic apparatus that includes a component having at least two or more fluidic thru-passageways (capillaries), each having an input end and an output end and oriented transversely to opposing major surfaces of the component; at least one electro-osmotic (e-o) pump disposed adjacent a bottom major surface of the component that is operatively associated (i.e., feeds, or controls) with at least two of the two or more fluidic thru-passageways at the input ends thereof, wherein all of the e-o pumps (even if there is just one) are operatively associated with all of the fluidic thru-passageways; a component for driving the at least one e-o pump; and a sealable fluid holder operatively coupled to the at least one e-o pump and a fluid supply. In an aspect, the switchable, electro-osmotic apparatus contains only a single e-o pump that is operatively associated with all of the fluidic thru-passageways. In an aspect, the switchable, electro-osmotic apparatus further includes a spacer disposed on a top major surface of the component. The invention disclosed immediately herein above may find applications as a switchable adhesion device that may adhere to any of a variety of smooth or textures surfaces or a rapidly controllable grip/release device for various objects.

In another non-limiting aspect, the switchable, electro-osmotic apparatus further includes a non-wetting, encapsulation medium disposed adjacent the output end surface of the component. In this aspect, droplets formed at the output ends of the thru passageways by action of the e-o pump on the fluid at the input ends of the thru-passageways become covered or encapsulated, by a thin membrane. In the absence of droplet wetability, the plurality of droplets may act as force transducers as their volume is controlled by the e-o pump. This aspect of the invention may find application as a switchable, force-producing device having an extremely compact form-factor (e.g., credit card format).

Additional features and advantages of the invention will be set forth in the following detailed description and will be readily apparent to those skilled in the art from that description and/or recognized by practicing the invention as described in following detailed description, the drawings, and the appended claims.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF EMBODIMENTS OF THE INVENTION

Non-limiting, exemplary embodiments of the invention are described below along with examples as illustrated in the accompanying drawings. Wherever possible, the same reference numbers will be used throughout the drawings to refer to the same or like parts.

Figure 1A:
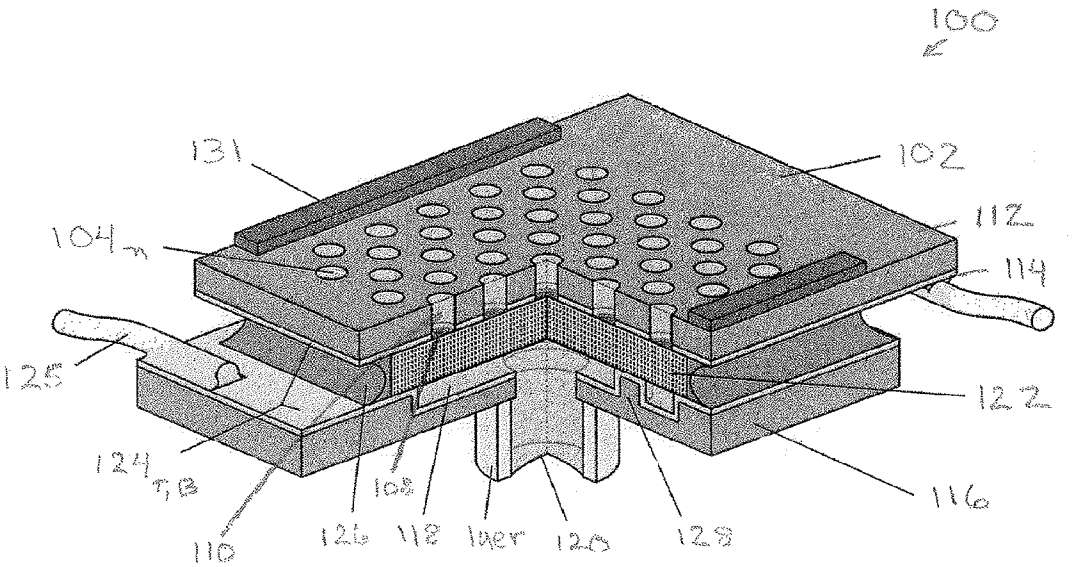
FIG. 1A schematically shows in cut-away view a Switchable Electronically-controlled Capillary Adhesion Device ("SECAD"), according to an illustrative embodiment of the invention.
Figure 3:
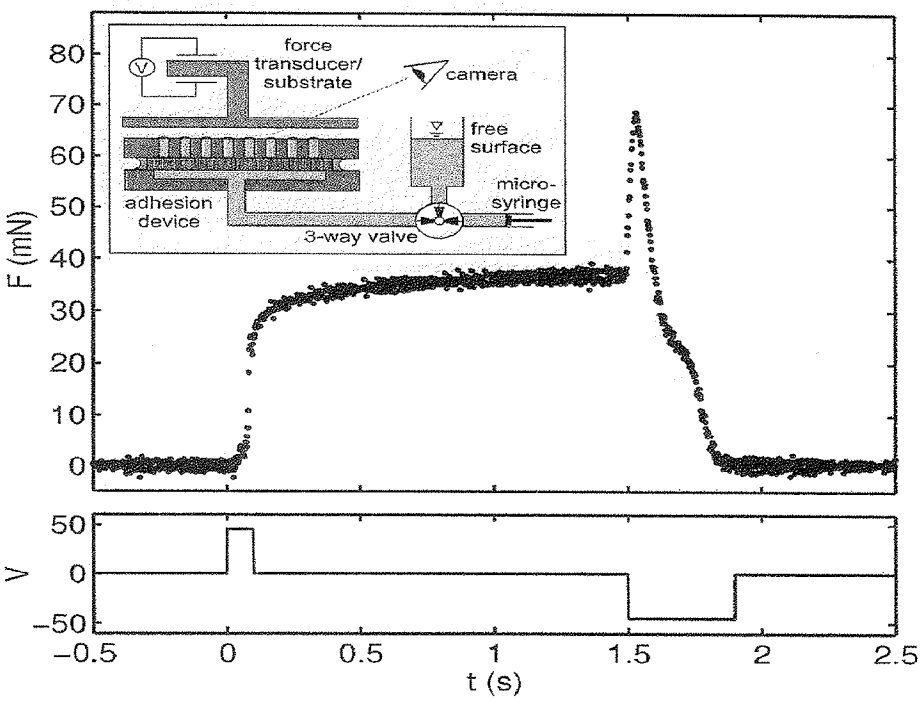
FIG. 3 shows the force (upper plot) felt by a substrate over time due to voltage pulses applied (lower plot) by an experimental SECAD device; the inset schematically shows the experimental setup, according to an illustrative aspect of the invention.

An exemplary embodiment of the invention will be referred to as a Switchable Electronically-controlled Capillary Adhesion Device ("SECAD") 100 as illustrated in FIG. 1A. The SECAD apparatus 100 includes a component 102 shown as a top plate having a plurality of fluidic thru-passageways $\mathbf{104}_n$ each having an input end 108 and an output end 110, oriented transversely to opposing major surfaces 112 (top), 114 (bottom) of the component 102. The apparatus is also shown including a bottom plate 116 that includes a fluid reservoir 118 having an inlet port 120. An e-o pump 122 is illustrated as a porous layer (e.g., a glass frit in an exemplary aspect, but not limited to such material) intermediate the top and bottom plates. The e-o pump has a sufficiently large zeta potential for controlling the volume of the droplets protruding from the top plate, as discussed in greater detail below. As illustrated, metallized inner surfaces $\mathbf{124}_{T,B}$ of the top and bottom plates 102, 116 serve as electrodes to apply an electric field across the sandwiched middle layer for activating the e-o pump. It will be appreciated by a person skilled in the art that this is not the only way to activate the one or more e-o pumps. Wire interconnects 125 to the electrodes are also shown. An epoxy seal 126 around the e-o pump layer is also shown. The inset in FIG. 3 shows a three-way valve 142, which provides a sealable fluid holder that is operatively coupled to the e-o pump and a fluid supply. The apparatus 100 as illustrated in FIG. 1A includes only a single e-o pump that is operatively coupled to (i.e., feeds; controls) all of the thru-passageways in the component; however, the embodied invention may include two or more individually-addressable e-o pumps, each feeding or controlling at least two respective thru-passageways in the component. For the embodiment shown and discussed in greater detail below, the working fluid used in the device is distilled water, but need not be limited to such.

An important consideration for proper operation of the exemplary SECAD, involves design and assembly care to minimize volume scavenging effects. Specifically, all droplet-to-droplet fluid communication must travel through the flow-restricting porous pump layer. Gaps between the pump and the top plate should be substantially eliminated so that thru-passageways are isolated from one another and directly contact the top surface of the pump. For example, exemplary devices were fabricated in two ways: a) with hard, plastic using a traditional machine shop (MS) approach, which were used for basic testing; and, b) of silicon wafers (SW) by standard photolithography techniques, which were used to demonstrate compact size. Typical device dimensions are 2×2 cm, with a thickness of 3-4 mm for SW devices. The smallest holes tested were $\epsilon$=150 μm, with N=4876 for $\phi$ (hole packing)=~0.4.

In SW devices, gap elimination was achieved by precisely fabricating the top layer of the glass frit to a flat surface to ensure good mating to the top plate. In MS devices, rubber gaskets and the top electrode were made to have identical hole patterns to the top plate and the devices were assembled with these layers carefully aligned. A non-limiting, exemplary order of assembly was: top plate, gasket, electrode plate, gasket, pump surrounded along sides by gasket, electrode, gasket, bottom plate/reservoir.

In an exemplary device, the hole arrays cover an area roughly 15 mm×15 mm. SW devices are compact in thickness, having top and bottom silicon wafers of 400 μm thickness each plus a 1.5-3 mm thick pumping layer. MS devices had top plates of 3 mm thickness, 4 mm pumping layer, and a large (25 mm) bottom plate thickness. Hole sizes ranged from $\epsilon$=150 to 900 μm, and the number of holes ranged from N=100 to 4876. The tightest hole packing tested ($\phi$=0.4) was sufficient for the liquid bridges (discussed in greater detail below) to remain isolated from each other. The reservoir in the experimental SW device was etched out (depth of ~150 μm) on the inner surface of the bottom plate with an array of small pillars (see 128, FIG. 1A) left standing to support the pumping material.

As mentioned above, the working fluid used in the exemplary embodiments is untreated commercial distilled water (Poland Springs®), and the e-o pumping materials are off-the-shelf porous glass frits, used as provided. Although we have previously tested well-characterized fluids and pumps to quantify electroosmosis (Barz, D. P. J., Vogel, M. J. & Steen, P. H., Determination of the zeta potential of porous substrates by droplet deflection: I. the influence of ionic strength and ph value of an aqueous electrolyte in contact with a borosilicate surface, Langmuir 25, 1842-1850 (2009), the subject matter of which is incorporated by reference in its entirety), we find that the use of untreated commercial distilled water and porous glass discs performs well, with a zeta potential of nearly 100 mV (based on in-house characterization) and minimal signs of pump strength deterioration over time. We have found that frits with "very fine" porosity (Robu, Germany, $R_{nominal}$=1.3 μm) are sufficient for pumping against droplets down to ϵ=300 μm at 10 V, and were used in obtaining the results presented herein. Other e-o pump materials with sufficiently fine pores, even with a reduced zeta potential, can pump against smaller droplets. Table 1 shows typical values of material properties and geometric parameters.

TABLE 1

| | Typical value | Description |
|---|---|---|
| ϵ | 150-900 mm | Hole diameter |
| N | 100-5000 | Number of holes |
| Ø | 0.1-0.4 | Packing density |
| α | 0.05 L-0.3 L | Spacer height |
| V | 5-40 V | Voltage drop |
| ζ | −0.1 V | Zeta potential |
| e | 710 pF/m | Electric permittivity |
| β | 1 | Geometric factor |
| R | 1.3 μm | Pump pore radius |
| L | 0.2-3 mm | Pump thickness |
| ψ | 0.25-0.4 | Pump porosity |
| σ | 55 mN/m | Surface tension |
| μ | $10^{-3}$ Pa s | Viscosity |
| $\theta_c$ | 68° | Contact angle |

Non-polar liquids (i.e., organics as opposed to water) may also be used to pump when properly doped, thus having an 'effective' zeta potential, as reported in Barz, D P J, M J Vogel and P H Steen, "Determination of the zeta potential of porous substrates by droplet deflection. II. Generation of electrokinetic flow in a non-polar liquid" Langmuir 26(5), 3126-313. 2010, the subject matter of which is incorporated herein by reference in its entirety.

Figure 2B:
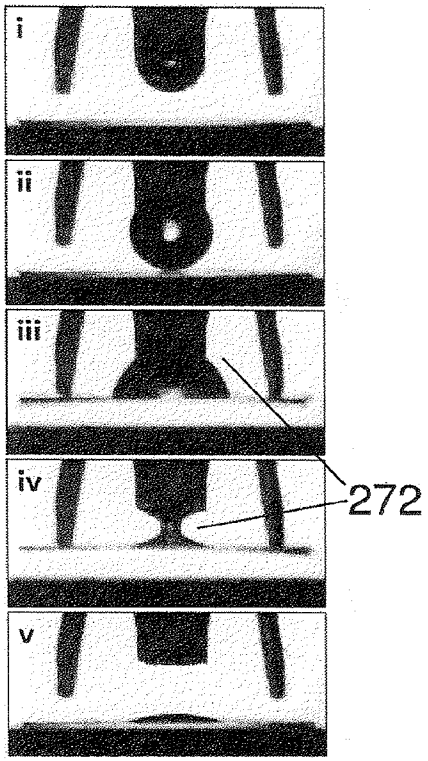
FIGS. 2A, 2B each show a cyclical sequence of the mechanism of control of switchable grab/release, according to an illustrative aspect of the invention.
Figure 2A:
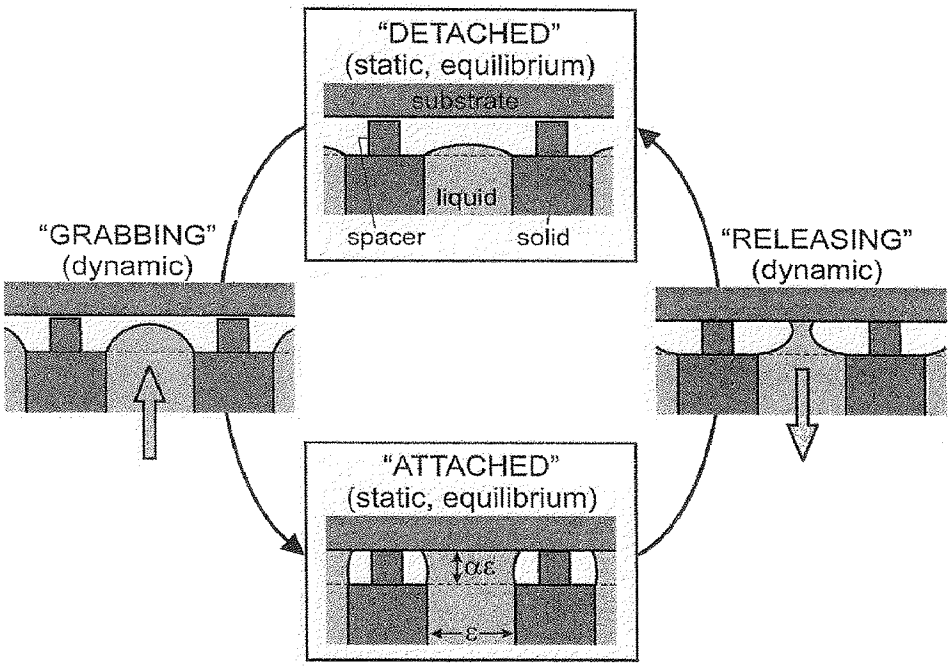

The mechanism of control of switchable grab/release by the exemplary SECAD 100 is illustrated in the cyclical sequences of FIGS. 2A and 2B. In FIG. 2A, top and bottom states represent static equilibria characterized by zero power consumption. Moving from one equilibria to the other is accomplished by pumping liquid into (left) or out of (right) the device (pump not shown). FIGS. 2B(i-v) show (i) formation of a droplet; (ii) contact of the droplet with an object surface; (iii) formation of a liquid 'bridge' 272 resulting in adhesion between the droplet and the object surface resulting in lifting of the object surface; (iv) removal of liquid from the bridge 272 of the droplet creating a peak force and adhesion strength on the object surface (note higher lifting distance) and ultimately breaking the bridge; and (v) release of the object. This is demonstrated further by the top and bottom plots shown in FIG. 3.

Operationally, again with reference to FIGS. 1A, 2A, a liquid droplet protrudes from a thru-hole with the liquid/gas interface pinned at the orifice-edge. Solid spacers 131 extend above the face-plane of the orifice to allow bridges (272, FIG. 2B(iii, iv)) of the height of the spacers to form. In grabbing, liquid is pumped out of the face pad until contact is made with the substrate and a liquid bridge (272, FIG. 2B(iii, iv)) forms between the device and substrate. In releasing, liquid is pumped back into the device until the bridge becomes unstable and breaks (FIG. 2B(v)). The spacer 131 in FIG. 1A assists with the release because it fixes the bridge length, enabling the liquid bridge to neck in until it pinches off and breaks. (This is akin to separating two glass slides with a drop of liquid between them easily done with spacers present but difficult if the slides are in contact). Both the attached and detached states persist indefinitely with no additional energy added to the system. Grab and release is activated by the e-o pump within a liquid-saturated porous material located beneath the field-of-view of FIG. 2A. The e-o pump moves liquid, efficiently against the resisting capillary pressure of the gas/liquid surfaces.

Figure 1B:
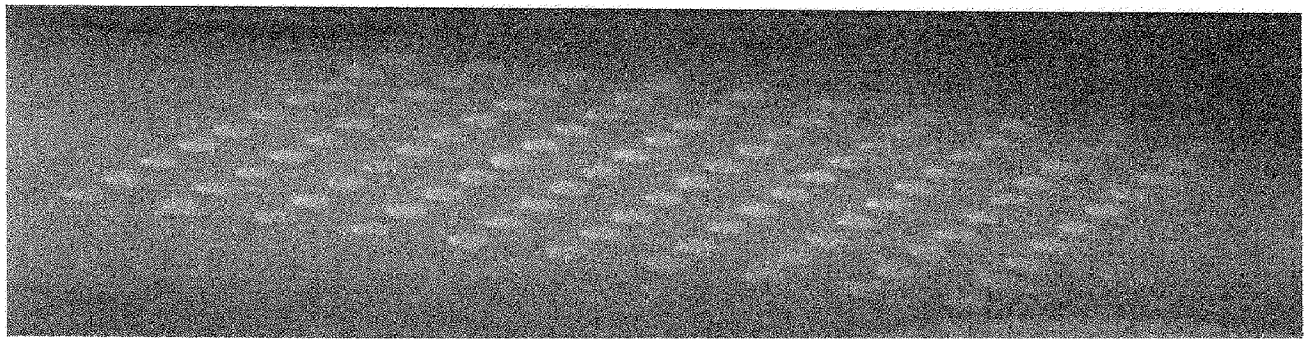
FIG. 1B illustrates the operation of the exemplary device just before a voltage pulse (t=0 s), and in FIG. 1C at t=2.0 s.
Figure 1C:
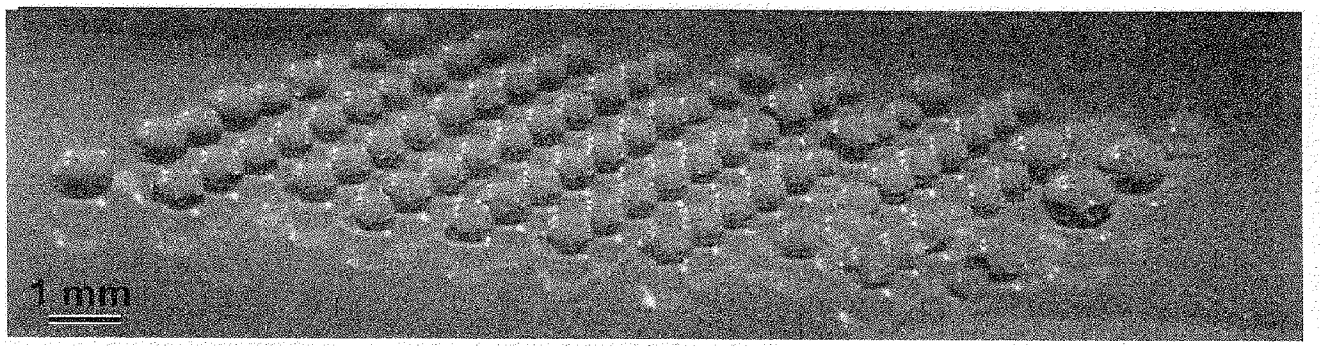

Basic e-o control of the droplets is shown in FIGS. 1B and 1C. Initially, the array of droplets extends barely above the top plate (FIG. 1B). A 12.5 V pulse applied to the pump for 2 s results in large droplets (FIG. 1C; no substrate is present). The observed electro-osmotic flow takes about 180 ms for the droplets to reach hemispherical volume compared to a predicted τ=150 ms.

FIGS. 1B and 1C further suggest applications beyond adhesion. For example, surface properties other than wetability (e.g., optical properties such as absorption/reflection or optical lensing may be modified in real time or, precise amounts of fluid may be delivered in microfluidic applications). However, droplet configurations like that in FIG. 1C tend to be unstable over long times due to volume scavenging. According to the embodied invention, volume scavenging is suppressed by designing a high inter-droplet flow resistance, particularly between the formed liquid bridges. This is achieved, for example, by choosing a small pore size for the pump material. Thus the middle device layer serves dual functions, as an e-o pump and as an enhanced flow-resistance retarder of volume scavenging.

In theory, pumping arises from the electric double-layer at a solid-liquid interface so that a material with large surface-area-to-volume is favored for the pump. Furthermore, according to the Smoluchowski approximation (Rice C L, Whitehead R (1965) Electrokinetic flow in a narrow cylindrical capillary, J Phys Chem 69:4017-4023), pump pressures scale with the inverse square of pore size, favoring small pores. In the exemplary SECAD, successful switching between the attached and detached states was demonstrated with a pump strength S sufficient to push out and pull back liquid, S>>1, where $S \equiv (2\epsilon|e\zeta V|)/\beta R^2\sigma$ is a dimensionless measure of the e-o driving force against the resistance to flow by capillarity. Here, e is the electric permittivity of the liquid, is the zeta potential of the liquid/porous material, V is the electric potential drop across the pump, β is a scaling factor of order unity, and R is the effective pore radius of the pumping material (see Table 1 for typical values). Note that S does not depend on N due to the parallel action of pressure across all thru-holes in the top plate. In the absence of a substrate and for N=2, the predictive capability of S has been demonstrated.

The maximum capillary pressure that the pump must overcome can be estimated as $4\beta\sigma/\epsilon$. It, represents the maximum pressure due to surface tension. For pumping droplets in and out of a hole of diameter $\epsilon$ (in the absence of a substrate, e.g., FIG. 1C), $\beta$ is bounded by the hemispherical capillary pressure ($\beta \leq 1$). In contrast, when bridges exist (in the presence of a substrate), $\beta$ can be considerably larger than unity and represents the maximum mean curvature that exists during a grab/release cycle. In this sense, it is a geometric parameter. $\beta=1$ for bridges of height $\alpha>0.15$, where the greatest capillary resistance is during "grab," approximated as hemispherical droplet. For shorter bridges, the greatest resistance is during detachment due to large-curvature in bridges and $\beta \approx 1/4\alpha$, assuming $\theta_c=90°$. The longer "release" pulses in FIG. 3A are due to this capillary resistance to e-o pumping.

The time $\tau$ to switch between the attached (approximated as cylindrical bridges) and detached (approximated as zero-volume droplets level with the orifice) states is the time to move a requisite volume by the imposed flow rate of the pump. $\tau$ can be approximated by independently known parameters, $\tau=\epsilon\phi\mu\alpha L/\psi|e\zeta V|$, where $\alpha$ is the non-dimensional spacer height (FIG. 2A, typical value is $\alpha \approx 0.2$), L is the porous layer thickness, $\mu$ is the liquid viscosity, and $\psi$ is the pump porosity. In the absence of a substrate and for N=2, the basic scaling of $\tau$ with the inverse of V when S>>1 has been demonstrated.

For porous pumps used in the embodied invention, we assume to first order that the full area of the pump contributes to flow, since the porous structure allows for lateral flow from the area between holes in the top plate. For a pumping structure with isolated pores (e.g., alumina membranes with cylindrical-like pores), the pumping area would be limited to the area directly beneath the holes, so the expression for $\tau$ should be modified by removing the factor of cp.

Figure 4:
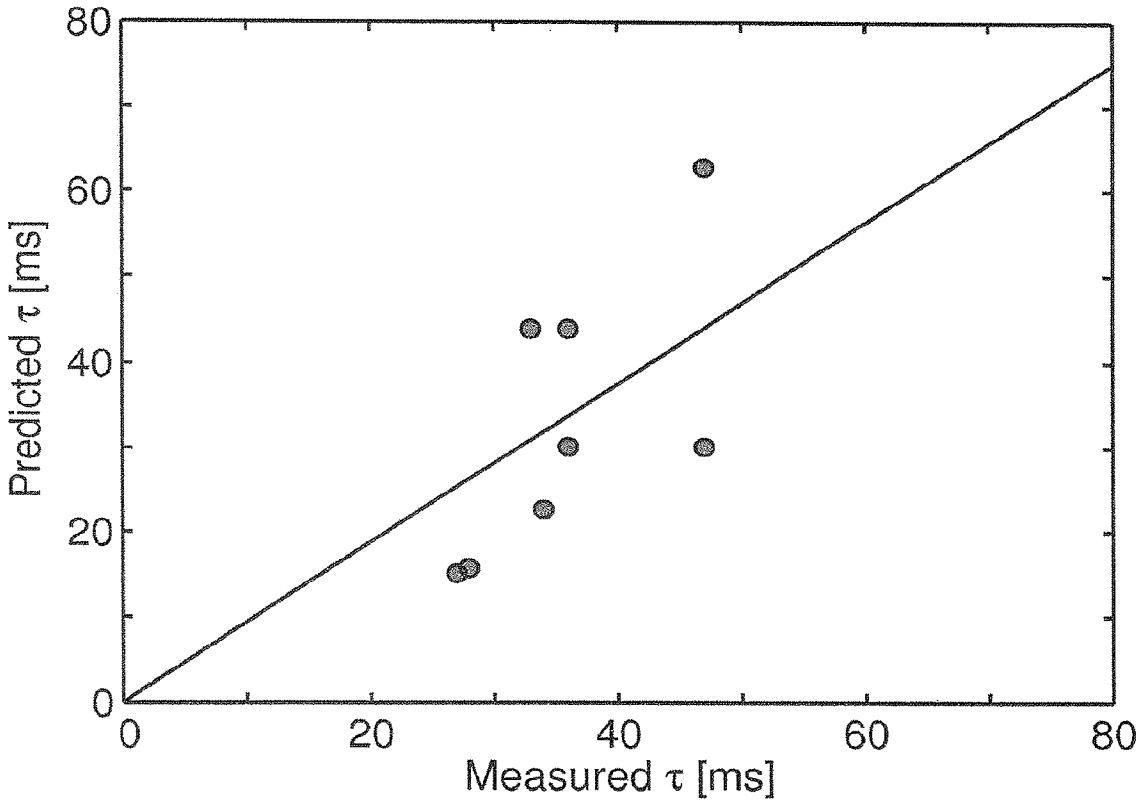
FIG. 4 shows predicted versus measured values of switching times, $\tau$, according to an illustrative aspect of the invention

A comparison of experimental results to the predicted value $\tau$ is shown in FIG. 4. Here the measured $\tau$ is the time from the start of the voltage pulse to the moment that the first droplet makes contact with the substrate.

We observed that the glass frit experimentally used for e-o pumping ($R \approx 1.3$ μm) becomes too weak to pump droplets smaller than $\epsilon \approx 300$ μm (S~1) at small voltages. This explains the slightly higher voltage (40 V) used in FIG. 3A Alternate pumping materials have been successfully tested. Anodic alumina and polymer membrane filters have smaller zeta potentials (10-40 mV), but are available with pore size down to 10 nm, which is sufficient for fast pumping in the embodied application. Also, coating similar membranes with a layer of silica has been shown to further increase the strength of the pump by increasing the zeta, potential. This provides justification for scaling of $\tau$ in Table 2.

The scaling example in Table 2 provides more detail regarding pump scaling. Here, a glass frit similar to that used in the reported experiments is used for $\epsilon>300$ μm, and an alumina porous disc is used for $\epsilon<300$ μm. Despite a smaller zeta potential, the alumina pump is stronger not only due to its finer pore size, but also due to its stronger electric field (same applied voltage over a much thinner pump). The smallest holes listed in Table 2 cannot be pumped by over-the-counter, pumping materials that we are aware of, though an electroosmotic pump should still be possible through materials modifications or alternate fabrication processes. Note that some degradation of electroosmosis due to electric double layer overlap in smaller pores is expected but not considered in Table 2.

TABLE 2

| Hole size $\epsilon$ (μm) | Number N | Strength N/cm$^2$ | Capacity (g) | Switch time $\tau$ (ms) |
|---|---|---|---|---|
| 1000 | 64 | 0.013 | 1.3 | 570 |
| 500 | 250 | 0.026 | 2.7 | 290 |
| 300 | 710 | 0.044 | 4.4 | 170 |
| 100 | 6400 | 0.13 | 13 | 57 |
| 10 | $6.4 \times 10^5$ | 1.3 | 130 | 5.7 |
| 1 | $6.4 \times 10^7$ | 13 | 1.3 kg | 0.57 |
| 0.1 | $6.4 \times 10^9$ | 130 | 13 kg | 0.057 |
| 0.01 | $6.4 \times 10^{11}$ | 1300 | 130 kg | 0.0057 |

The Table 2 parameters are based on a device with area 1 cm$^2$, hole packing $\phi=0.5$, bridge height $\alpha=0.25$, voltage drop across pump V=10 V, clean water $\sigma=72$ mN/m, and atmospheric adhesion. "$SiO_2$" pump is 1 mm thick, with $\zeta=100$ mV, mean pore radius R=1.5 μm, and porosity $\psi=0.3$. "$Al_2O_3$" pump is 120 μm thick, with $\zeta=40$ mV, and $\psi=0.4$.

In an exemplary aspect, contact lines of the droplets/bridges are fixed along the corner of the circular orifice by a combination of geometry and chemistry. The outer surfaces of the SW devices are coated with an anti-stiction monolayer of FOTS (fluoro-octyltrichloro-silane) via molecular vapor deposition (reported contact angle with water $\theta_c=110°$. The MS devices rely on lips around the orifice produced by a prescribed drilling protocol to pin the contact line.

In addition to the perimeter force, surface tension can generate a force via the Young-Laplace pressure equal to $\sigma\pi\kappa\epsilon^2/4$ per contact, where $\kappa$ is the sum of the principal curvatures of the surface. In contrast to the perimeter force, which for bridges can only pull the substrate toward the liquid, the Young-Laplace force can either push or pull depending on the sign of $\kappa$. When pressure enhances perimeter adhesion, as occurs for sufficiently necked-in bridges, we refer to this contribution as "shape suction." An example of shape suction is the force-spike seen during release in FIG. 3A. By clamping the force at such a peak, for example, by a valve closure or pump action, the adhesion strength of the exemplary SECAD can be amplified tenfold. Such an array of "necked-in" bridges can still be a stable equilibrium, so that no additional energy (beyond the energy necessary to decrease the volume and close the valve) is required to freeze the system at this elevated force.

Magnitudes of adhesion capacity are modest (order of 10 g) for the tested devices, but the scaling of adhesion strength suggests that much greater strengths are possible, even without shape suction. The general expression for adhesion strength (normal stress acting over net device area) based only on contact perimeter is:

$$F/A_{net}=4\phi\sigma \sin \theta_c/\epsilon.$$

The scaling laws presented here are illustrated in Table 1 and Table 2, above. Adhesion of 1 bar is predicted for a hole size between 1 and 10 μm. At the smallest droplet sizes, the adhesion strengths are competitive with synthetic bio-inspired tapes or commercial adhesives and even approach the yield strength of plastics and aluminum, none of which enjoy the benefits of controlled (switchable) grab/release mechanism.

Materials and Methods

The silicon wafer (SW) devices consist of a top and bottom plate that are fabricated by standard photolithography methods. The silicon wafers were initially oxidized in an annealing furnace to achieve a 1.5 μm oxide layer. The wafers were then heated to remove any moisture prior to spin-coating with photoresist. Following a soft-bake of the resist, the hole array pattern was imprinted from a chrome mask onto the wafer by contact mask alignment, then hard-baked and exposed. Subsequently, the wafers were reactive-ion etched using the fluorine-based PlasmaTherm 72 and then deep etched via Unaxis 770. The individual arrays were then cleaved from the wafer. An electrode was then evaporated on the inner surfaces of the plates (Layer 1: 120 angstroms of titanium; Layer 2: 1600 angstroms of gold).

Machine shop (MS) devices were made with traditional tools (standard drilling for holes) with Delrin (polyoxymethylene) used for top and bottom plates, and perforated stainless steel as electrodes.

Device Assembly

The operation and performance of the MS and SW devices are very similar despite differences in assembly. In both cases a pumping layer is sandwiched between the top plate and bottom plate. SW devices are permanently held together and sealed by a bead of epoxy around the perimeter (note the lateral offset between top and bottom plates in FIG. 1A to aid in assembly). MS devices were assembled with several rubber gaskets and clamped together with screws.

In "substrate-pendant" and "device-pendant" tests, spacers were used to control liquid bridge height. The spacers (~25-60 μm thick) used in the experiments were made of a variety of materials, including tapes or shim stock bonded around the perimeter of the top plate.

Force Measurement and Data Normalization

The substrate was rigidly attached to a fast-response load cell (Transducer Techniques, GSO-10), which was connected to a personal computer with data acquisition card (National Instruments, PCI-6014). In order to compare "force-transducer experiment" results, the data must be normalized to account for variations between devices and experiments. Overfilling can cause contact line motion. In one case, the overfilling was caused by the pump area extending slightly beyond the area covered by the hole array. For this reason, we used $\epsilon_{meas}$, which is the average measured contact diameter of all bridges (obtained via image analysis), rather than the nominal hole size (as fabricated). We also normalized the measured, forces by the total measured wet contact area, $A_{meas}=\pi N_{meas}\epsilon^2_{meas}/4$. For the experiment in FIG. 3, $\epsilon_{meas}=530$ μm and the normalized adhesion strength is $F/A_{meas,\,wet}=403$ Pa. Errors in $\epsilon_{meas}$ can be as high as 10% due to limited camera resolution and imaging challenges.

According to another non-limiting aspect, the switchable, electro-osmotic apparatus further includes a non-wetting, encapsulation medium disposed adjacent the output end surface of the component. In this aspect, droplets formed at the output ends of the thru-passageways by action of the e-o pump on the fluid at the input ends of the thru-passageways become covered by a thin membrane. In the absence of droplet wetability, the plurality of droplets act as force transducers as their volume is controlled by the e-o pump. This aspect of the invention may find application as a switchable, force-producing device having an extremely compact form-factor (e.g., credit card format).

All references, including publications, patent applications, and patents cited herein are hereby incorporated by reference in their entireties to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

We claim:

1. A switchable, electro-osmotic apparatus, comprising:

a top component having opposing inner and outer major surfaces and a plurality of fluidic thru-passageways each having an input end and an output end, oriented transversely to the opposing major surfaces of the top component, wherein each of the fluidic thru-passageways is fluidically isolated from one another, further wherein the outer major surface forms an external surface of the switchable, electro-osmotic apparatus;

at least one electro-osmotic pump disposed adjacent the inner major surface of the top component and operatively associated with at least two of the plurality of fluidic thru-passageways at the input ends thereof, wherein the at least one electro-osmotic pump is operatively associated with all of the plurality of fluidic thru-passageways;

a top electrode operatively connected to the inner major surface of the top component;

a bottom component having opposing inner and outer major surfaces;

a bottom electrode operatively connected to the inner major surface of the bottom component;

wherein the at least one electro-osmotic pump is disposed adjacent the inner major surface of the bottom component; and a sealable fluid holder operatively coupled to the at least one electro-osmotic pump and a fluid supply, wherein the at least one electro-osmotic pump and the plurality of fluidic thru-passageways are characterized by design parameters that are effective to substantially eliminate a scavenging effect between adjacent fluidic units disposed at the output ends of respective adjacent fluidic thru-passageways during formation of a liquid bridge resulting in an actuated phase of the apparatus.

2. The switchable, electro-osmotic apparatus of claim 1, wherein the at least one electro-osmotic pump is only a single electro-osmotic pump that is operatively associated with all of the plurality of fluidic thru-passageways.

3. The switchable, electro-osmotic apparatus of claim 1, wherein the top and bottom electrodes comprise metalized surfaces disposed on the inner major surfaces of the top and bottom components and in operative contact with the at least one electro-osmotic pump.

4. The switchable, electro-osmotic apparatus of claim 1, further comprising a spacer disposed on the outer major surface of the top component.

5. The switchable, electro-osmotic apparatus of claim 1, further comprising a layer of anti-stiction material disposed in contact with the outer surface of the top component.

6. The switchable, electro-osmotic apparatus of claim 1, wherein the at least one electro-osmotic pump is disposed immediately adjacent the inner major surface of the top component.

7. The switchable, electro-osmotic apparatus of claim 1, wherein each of the fluidic thru-passageways is disposed parallel to one other.

8. A switchable, electro-osmotic apparatus, comprising:

a top component having opposing inner and outer major surfaces and a plurality of fluidic thru-passageways each having an input end and an output end, oriented transversely to the opposing major surfaces of the top component, wherein each of the plurality of fluidic thru-passageways has a lip encircling the output end thereof, further wherein each of the fluidic thru-passageways is fluidically isolated from one another, further wherein the outer major surface forms an external surface of the switchable, electro-osmotic apparatus;

at least one electro-osmotic pump disposed adjacent the inner major surface of the top component and operatively associated with at least two of the plurality of fluidic thru-passageways at the input ends thereof, wherein all of the at least one electro-osmotic pump is operatively associated with all of the plurality of fluidic thru-passageways;

a top electrode operatively connected to the inner major surface of the top component;

a bottom component having opposing inner and outer major surfaces;

a bottom electrode operatively connected to the inner major surface of the bottom component;

wherein the at least one electro-osmotic pump is disposed adjacent the inner major surface of the bottom component; and a sealable fluid holder operatively coupled to the at least one electro-osmotic pump and a fluid supply.

9. The switchable, electro-osmotic apparatus of claim 8, wherein each of the fluidic thru-passageways is disposed parallel to one other.

10. A switchable, electro-osmotic apparatus, comprising:

a top component having opposing inner and outer major surfaces and a plurality of fluidic thru-passageways each having an input end and an output end, oriented transversely to the opposing major surfaces of the top component, wherein the outer major surface forms an external surface of the switchable, electro-osmotic apparatus;

at least one electro-osmotic pump disposed adjacent the inner major surface of the top component and operatively associated with at least two of the plurality of fluidic thru-passageways at the input ends thereof, wherein the at least one electro-osmotic pump is operatively associated with all of the plurality of fluidic thru-passageways; and a top electrode operatively connected to the inner major surface of the top component;

a bottom component having opposing inner and outer major surfaces;

a bottom electrode operatively connected to the inner major surface of the bottom component;

wherein the at least one electro-osmotic pump is disposed adjacent the inner major surface of the bottom component; and a sealable fluid holder operatively coupled to the at least one electro-osmotic pump and a fluid supply, wherein the at least one electro-osmotic pump is characterized by a pumping strength parameter, $S \equiv [(2\epsilon|e\zeta V|)/\beta R^2\sigma]$, where $S>1$.

11. The switchable, electro-osmotic apparatus of claim 10, wherein the at least one electro-osmotic pump is only a single electro-osmotic pump that is operatively associated with all of the plurality of fluidic thru-passageways.

12. The switchable, electro-osmotic apparatus of claim 10, wherein the at least one electro-osmotic pump and the plurality of fluidic thru-passageways are characterized by design parameters that are effective to substantially eliminate a scavenging effect between adjacent fluidic units disposed at the output ends of respective adjacent fluidic thru-passageways during formation of a liquid bridge resulting in an actuated phase of the apparatus.

13. The switchable, electro-osmotic apparatus of claim 10, wherein the top and bottom electrodes comprise metalized surfaces disposed on the inner major surfaces of the top and bottom components and in operative contact with the at least one electro-osmotic pump.

14. The switchable, electro-osmotic apparatus of claim 10, further comprising a spacer disposed on the outer major surface of the top component.

15. The switchable, electro-osmotic apparatus of claim 10, further comprising a layer of anti-stiction material disposed in contact with the outer major surface of the top component.

16. The switchable, electro-osmotic apparatus of claim 10, wherein each of the plurality of fluidic thru-passageways has a lip encircling the output end thereof.

17. The switchable, electro-osmotic apparatus of claim 10, wherein each of the fluidic thru-passageways is disposed parallel to one other.

18. A switchable, electro-osmotic apparatus, comprising:

a top component having opposing inner and outer major surfaces and a plurality of fluidic thru-passageways each having an input end and an output end, oriented transversely to the opposing major surfaces of the top component, wherein each of the fluidic thru-passageways is fluidically isolated from one another, wherein the outer major surface forms an external surface of the switchable, electro-osmotic apparatus;

at least one electro-osmotic pump disposed adjacent the inner major surface of the top component and operatively associated with at least two of the plurality of fluidic thru-passageways at the input ends thereof, wherein the at least one electro-osmotic pump is operatively associated with all of the plurality of fluidic thru-passageways; and a top electrode operatively connected to the inner major surface of the top component;

a bottom component having opposing inner and outer major surfaces;

a bottom electrode operatively connected to the inner major surface of the bottom component;

wherein the at least one electro-osmotic pump is disposed adjacent the inner major surface of the bottom component; and an encapsulation medium disposed adjacent the output end surface of the component.

19. The switchable, electro-osmotic apparatus of claim 18, wherein the encapsulation medium is a thin membrane.

20. The switchable, electro-osmotic apparatus of claim 18, wherein each of the fluidic thru-passageways is disposed parallel to one other.

* * * * *

UNITED STATES PATENT AND TRADEMARK OFFICE

CERTIFICATE OF CORRECTION

PATENT NO. : 8,998,584 B2
APPLICATION NO. : 13/574702
DATED : April 7, 2015
INVENTOR(S) : Paul H. Steen et al.

It is certified that error appears in the above-identified patent and that said Letters Patent is hereby corrected as shown below:

In the claims:

Column 11, claim 8, line 39, after "wherein" delete "all of".

Signed and Sealed this
Seventeenth Day of November, 2015

Michelle K. Lee

Michelle K. Lee
*Director of the United States Patent and Trademark Office*